United States Patent [19]

Way

[11] Patent Number: 4,645,439

[45] Date of Patent: Feb. 24, 1987

[54] ADJUSTABLE GEAR PUMP

[75] Inventor: Donald R. Way, Scottsdale, Ariz.

[73] Assignee: The Garrett Corporation, Los Angeles, Calif.

[21] Appl. No.: 801,665

[22] Filed: Nov. 25, 1985

[51] Int. Cl.[4] ..... F04C 11/00; F04C 18/08

[52] U.S. Cl. ..... 418/104; 418/108; 418/206

[58] Field of Search ..... 418/104, 107, 108, 206, 418/70; 415/126–128

[56] References Cited

U.S. PATENT DOCUMENTS

| | | | |
|---|---|---|---|
| 246,724 | 9/1881 | Clark | 418/108 |
| 2,855,854 | 10/1958 | Aspelin | 418/206 |
| 2,986,097 | 5/1961 | Chrzanowski | 418/104 |
| 3,208,393 | 9/1965 | Kosch | 418/108 |
| 3,433,168 | 3/1969 | Banker | 418/108 |
| 3,560,121 | 2/1971 | Noell | 418/108 |

*Primary Examiner*—Carlton R. Croyle
*Assistant Examiner*—Jane E. Obee
*Attorney, Agent, or Firm*—Stuart O. Lowry; Albert J. Miller

[57] ABSTRACT

A gear pump is provided with a pair of rotatable pumping gears for pumping fluid between inlet and outlet ports formed in a gear pump housing, wherein a portion of the housing is adapted for positional adjustment to reduce internal operating clearances and thereby regenerate pump output performance without requiring pump disassembly or rebuilding.

5 Claims, 3 Drawing Figures

ADJUSTABLE GEAR PUMP

BACKGROUND OF THE INVENTION

This invention relates generally to gear pumps for use in pumping liquid substances and the like. More specifically, this invention relates to an improved gear pump adapted for rapid and easy adjustment of internal operating clearances without requiring pump disassembly.

Gear pumps in general are well known in the art and typically comprise a matched set of meshing spur gears carried on parallel rotating shafts and mounted generally within a contoured gear pocket or chamber within a pump housing. The pumping gears are rotated together causing their gear teeth to sweep a fluid from a housing inlet port to an outlet port typically at an elevated discharge pressure. Such gear pumps are most commonly used in the prior art for pumping hydraulic fluids and other liquid substances, such as oils, fuels, and the like, frequently at relatively high output pressures.

For optimum performance capacity, gear pumps are designed with relatively close and, in some cases, substantially zero internal operating clearances to prevent significant fluid bypass leakage between the housing inlet and outlet ports. More specifically, as the gear teeth of each pumping gear rotate away from the housing inlet port, the radially outermost tips of the gear teeth move in close running clearance with a respective pair of arcuate pressure faces defined by the gear pump housing and located at relative positions between the inlet and outlet ports. This close running clearance between the gear teeth tips and the pressure faces is designed to prevent significant fluid leakage in the reverse direction from the outlet port to the inlet port, wherein such leakage would have an adverse affect upon pump output pressure. Accordingly, the provision of close running or operating clearances permits gear pump operation at a relatively high output pressure capacity.

One disadvantage encounterend with traditional gear pumps, however, is that they tend to experience significant reductions in output pressure performance capacity in response to component wear. That is, pump operation inherently results over a period of time in mechanical wear especially between the outer tips of the pumping gear teeth and the housing pressure faces. Alternately, such wear can occur rapidly upon ingestion of fluid-entrained grit or upon use to pump caustic or abrasive materials. This wear is accompanies by an increase in the operating clearance between the gear teeth tips and the pressure faces to result, in some instances, in dramatic reductions in output pressure capacity. As one illustrative example, in a gear pump designed for an operating clearance of about 0.001 inch and a design output pressure of about 500 psi, a wear-induced increase in the operating clearance to about 0.005 inch can result in a reduction in output pressure to 50–60 psi.

In the past, upon experiencing a degradation in pump output pressure to a level below a design on rated threshold, it has been necessary to disassemble the gear pump for purposes of rebuilding or repair. Such pump disassembly and overhaul, however, require significant manual labor and skill and further require the gear pump to be removed from service for a significant period of time.

There exists, therefore, a significant need for an improved gear pump capable of providing a fluid output at a relatively high pressure, wherein the pump can be adjusted quickly and easily and preferably from the exterior of the pump to regenerate pump performance in compensation for component wear. The present invention fulfills these needs and provides further related advantages.

SUMMARY OF THE INVENTION

In accordance with the invention, an improved gear pump is provided of the type having meshed pumping gears rotatable within a gear pump housing to deliver fluid from an inlet port to an outlet port. The gear pump housing defines an internal pumping chamber within which the rotating gears are seated, with pressure faces lining said chamber and disposed in close or substantially zero clearance relation with the peripheral tips of the pumping gear teeth. these pressure faces are adapted for rapid positional adjustment to compensate for gear tooth and/or pressure face wear, thereby regenerating pump output pressure performance capacity.

In accordance with the preferred form of the invention, the gear pump housing comprises a slider plate sandwiched between a pair of outer housing members. The slider plate includes an enlarged contoured opening to define the pumping chamber and having a height generally corresponding with the axial dimensions of the pumping gears. The pumping gears are supported in meshed relation within the pumping chamber by rotatable shafts carried within bearings on the housing members. Connector bolts are fastened bewteen the housing members and pass through elongated bolt slots int he slider plate which accommodate slider plate adjustment relative to the housing members. In addition, alignment pins extend bewteen the housing members and pass through elongated adjustment slots formed in the slider plate. Adjustment screws are carried by the slider plate and extend into bearing engagement with the alignment pins, whereupon adjustment screw rotation draws the slider plate in a direction displacing the pressure faces toward reduced operating clearance relation with the pumping gears.

In use, the pumping gears are rotatably driven within the pumping chamber to deliver fluid, such as oil, fuel, or the like, from an inlet port to an outlet port formed in one or both of the housing members. For optimum performance, the outer tips of these pumping gears rotate in substantially zero clearance relation with the slider plate pressure faces. However, when pump output pressure performance falls below a selected threshold, the connector bolts are loosened sufficiently to permit slider plate adjustment upon rotation of the adjustment screws to draw the pressure faces into substantially zero clearance relation with the pumping gears. The connector bolts are then retightened and the pump returned to duty with regenerated preformance and without requiring pump disassembly. If desired, the pressure faces can be lined by a soft material, such as a metal-based spray material, for rapid conformance with the rear teeth tips upon resumed pump operation.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
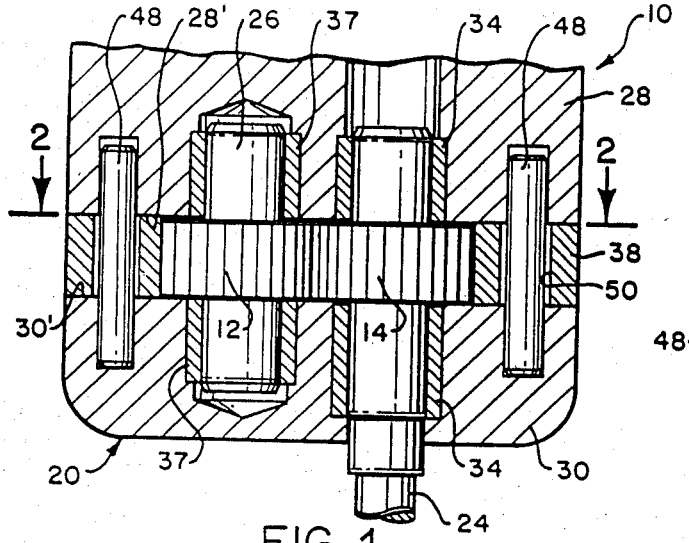
FIG. 1 is a sectional view illustrating an adjustable gear pump embodying the novel features of the invention.

As shown in the exemplary drawings, an improved gear pump is referred to generally by the reference numeral 10. The gear pump 10 includes meshing pumping gear 12 and 14 for displacing fluid from an inlet port 16 to an outlet port 18, wherein the internal operating clearance of the pump can be readjusted quickly and easily to regenerate pump performance without requiring disassembly and rebuilding.

The improved gear pump 10 of the present invention is designed for use with a broad range of fluids, typically liquid-based substances, such as hydraulic fluids, oils, fuels, slurries, and the like. The gear pump 10 is adapted for relatively high pressure output capacity incident to relatively small and substantially zero internal operating clearances. In the event of sufficient wear of the pump operating components to cause output pressure capacity to fall below a predetermined performance level, the pump 10 of the present invention can be adjusted quickly and easily to reduce the internal operating clearances in a manner regenerating pump output capacity and without requiring pump disassembly or rebuilding.

As shown in the accompanying drawings, the pumping gears 12 and 14 comprise a pair of spur gears having substantially indentical sets of meshing peripheral gear teeth 12' and 14'. These pumping gears 12 and 14 are supported within a gear pump housing 20 for rotational movement in meshed relation within a contoured pumping chamber 22. A rotatable drive shaft 24 is connected to the pumping gear 14 to impart rotational movement thereto, wherein such rotation of the gear 14 is coupled to and correspondingly rotates the other pumping gear 14 carried on an idler shaft 26.

The gear pump housing 20 defines the pumping chamber 22 and rotationally supports the pumping gears 12 and 14 within said chamber. More particularly,this gear pump housing 20 comprises upper and lower housing members 28 and 30 respectively including generally planar inboard surfaces 28' and 30' presented toward one another. Shaft bores 32 and 33 are formed within housing members 28 and 30 to receive appropriate bearings, such as sleeve bearing 34 and the like, for rotatably supporting the drive shaft 24. Additional shaft bores 35 and 36 in the housing members receive sleeve bearings 37 or the like for supporting the idler shaft 26 inparallel relation with the drive shaft 24. The inlet and outlet ports 16 and 18 are formed in the housing members 28 and 30, respectively, although these ports may be formed in the same housing member, if desired.

A central adjustable slider plate 38 also forms a portion of the gear pump housing 20 and is interposed in sandwiched relation between the upper and lower housing members 28 and 30. More particularly, as shown best in FIG. 3, this slider plate 38 is shaped for flush mating engagement with the upper and lower housing members and includes a central contoured gear pocket or chamber defining the pumping chamber 22 surrounding the pumping gears 12 and 14. An enlarged lobe 41 is disposed at one side of the pumping chamber 22 in general alignment with the inlet port 16 in the lower housing member 30 for inflow of fluids into the chamber. Similarly, the chamber 22 includes a second enlarged lobe 42 in general alignment with the outlet port 18 of the pump 10.

The slider plate 38 and the housing members 28 and 30 are interconnected for normal pump operatio by a plurality of connector bolts 44, four of which are depicted in the exemplary drawings. As shown, these connector bolts 44 extend through the lower housing 30 and are passed through respective elongated slots 46 in the slider plate 38 for attachment in any suitabl manner to the upper housing member 28. In addition, close alignment is maintained between the upper and lower housing members by means of a pair of alignment pins 48 anchored as by press-fitting into the housing members and passed through elongated adjustment slots 50 in the slider plate.

Figure 2:
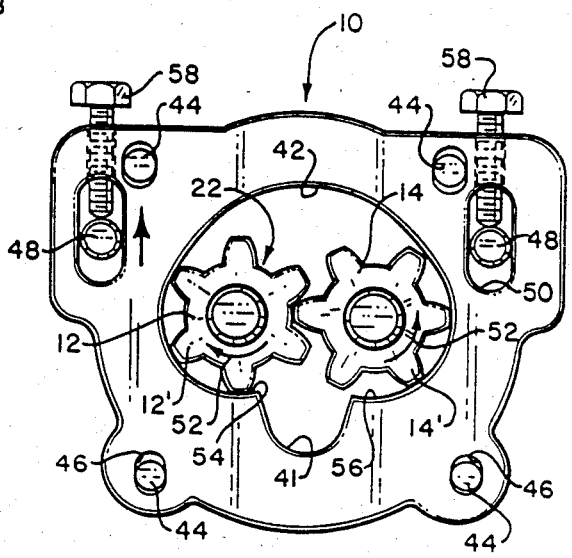
FIG. 2 is a sectional view taken generally on the line 2—2 of FIG. 1.

In normal operation of the gear pump 10, the drive shaft 24 is rotatably driven from a suitable power source (not shown) to rotate the pumping gears 12 and 14 in the directions depicted by the arrows 52 in FIG. 2. Such rotation sweeps the gear teeth 12' and 14' of the gears in directions laterally away from the inlet lobe 41 to correspondingly pick up incoming fluid between the teeth and sweep the fluid in opposite directions toward the outlet lobe 42. Importantly, through an initial portion of this rotataional movement adjacent the inlet lobe 41, the readially outermost tips of the gear teeth 12' and 14' pass in relatively close and preferably substantially zero clearance relation with a respective pair of arcuate pressure faces 54 and 56 formed on the slider plate and lining the pumping chamber. These pressure faces each extend from the inlet lobe 41 through an arcuate width typically on the order of about forty to fifty degrees or more prior to outward expansion of the slider plate geometry for substantial clearance relative to the gear teeth tips. In one preferred form, these pressure faces are lined by a relatively soft material, such as an aluminum-based metal spray material or the like.

Figure 3:
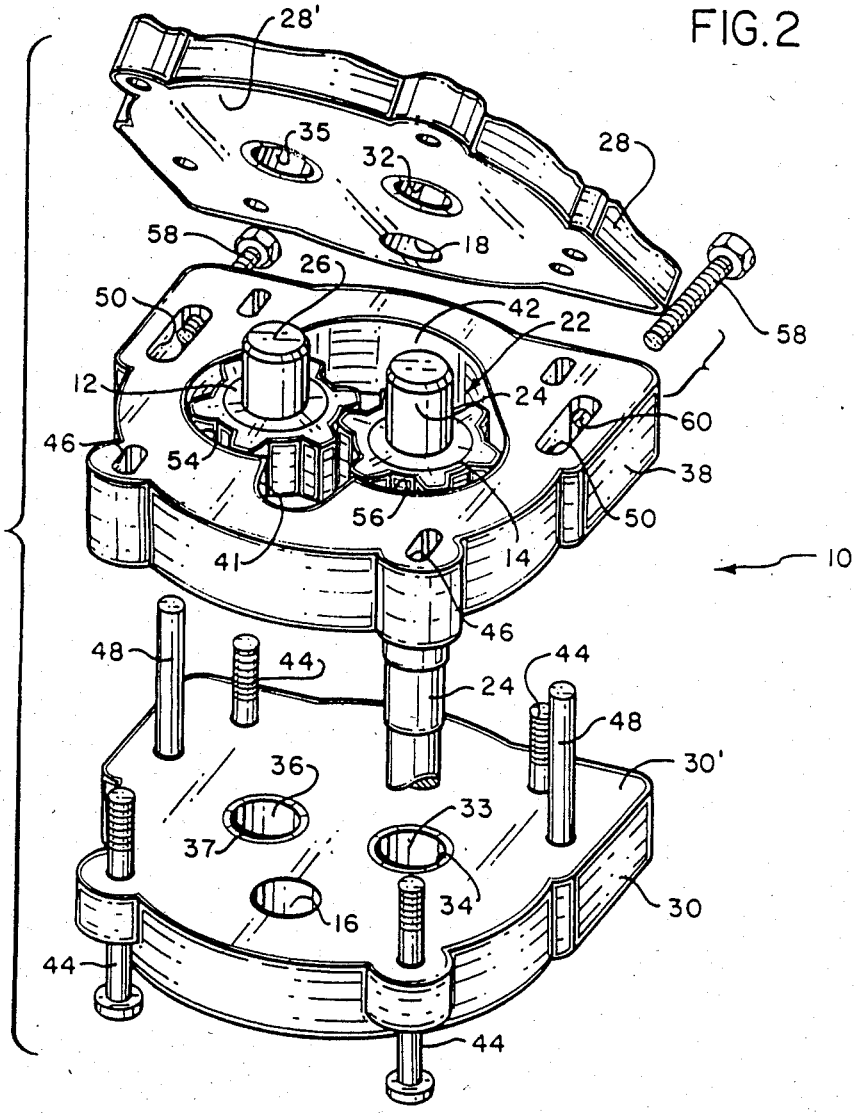
FIG. 3 is a fragmented exploded perspective view illustrating assembly of the various components forming the adjustable gear pump of the invention.

In the event of relative component wear between the tips of the gear teeth 12' and 14' and the pressure faces 54 and 56, the slider plate 38 is adjustable in position quickly and easily to return the pressure faces into close operating clearance relation with the gear teeth. More specifically, the connector bolts 44 can be loosened without disconnection or gear pump disassembly to permit slider plate motion between the housing members 28 and 30. As shown in FIGS. 2 and 3, slider plate adjustment is accomplished by rotation of a pair of adjustment screws 58 extending generally coaxially in the slots 50 through threaded bores 60 in the slider plate and into bearing contact with the alignment pins 48 within the slots 50. By orienting the alignment screws 58 generally in parallel with the connector bolt slots 46 and the alignment slots 50, and further generally perpendicular to the pressure faces 50 and 54, alignment screw rotational advancement effectively draws the slider plate 38 in a direction displacing the pressure faces to reduce operating clearances with respect ot the gear teeth tips. This adjustment is permitted by appropriate enlargement of the outlet lobe 42 and further by the slots 46 and 50 which prevent undesired sideways sliding motion. The connector bolts 44 can then be retightened and gear pump operation resumed.

Accordingly, the output pressure capacity of the pump can be regenerated quickly from the exterior of the pump housing and without the need for pump disassembly or reworking or replacement of components. Substantially zero operating or running clearances can thus be maintained over a prolonged service life.

A variety of modifications and improvements to the inventio described herein are believed to be apparent to those skilled in the art. Accordingly, no limitation is intended on the invention by way of the description and drawings, except as set forth in the appended claims.

What is claimed is:

1. A gear pump, comprising:

a gear pump housing including a pair of housing members with a slider plate sandwiched therebetween said slider plate having an enlarged pocket therein cooperating with said housing members to define a pumping chamber, means forming an inlet port and an outlet port communicating with said pumping chamber, and means on said slider plate forming a pair of pressure faces disposed generally between said inlet and outlet ports;

a pair of pumping gears within said pumping chamber;

means for rotatably supporting said pumping gears within said pumping chamber with a portion of the peripheral tips of said pumping gears respectively in relatively close running clearance with said pressure faces;

means for slidably adjusting the position of said slider plate relative to said housing members to selectively reduce the running clearance between said pumping gears and said pressure faces; and further including means for interconnecting said housing members and extending through a slot formed in said slider plate, said slot being elongated in a direction permitting slider plate movement to increase and decrease said running clearance, said adjustment means being carried by said slider plate in bearing engagement with said interconnecting menas for adjusting the position of said slider plate between said housing members.

2. A gear pump, comprising:

a gear pump housing including a pair of housing members with a slider plate sandwiched therebetween, said slider plate having an enlarged pocket therein cooperating with said housing mebmers to define a pumping chamber, means forming an inlet port and an outlet port communicating with said pumping chamber, and means on said slider plate forming a pair of pressure faces disposed generally between said inlet and outlet ports;

a pair of pumping gears in meshed relation within said pumping chamber;

a drive shaft for rotatably driving one of said pumping gears;

an idler shaft for rotatably supporting the other of said pumping gears;

bearing means on said housing members for rotatably supporting said drive and idler shafts;

means for interconnecting said housing members in fixed relation to each other, said interconnecting means extending through a slot formed in said slider plate, said slot being elongated in a direction permitting slider plate movement to increase and decrease the runnign clearance between said pressure faces and said pumping gears;

means for slidably adjusting the position of said slider plate between said housing members to select the running clearance of said pressure faces relative to said pumping gears; and means for releasably securing said slider plate with respect to said housing members, said adjusting means being carried by said slider plate in bearing engagement with said interconnecting means for adjusting the position of said slider plate between said housing members.

3. A gear pump, comprising:

a gear pump housing including a pair of housing members with a slider plate sandwiched therebetween, said slider plate having an enlarged pocket therein cooperating with said housing members to define a pumping chamber, means forming an inlet port and an outlet port communicating with said pumping chamber, and means on said slider plate forming a pair of pressure faces disposed generally between said inlet and outlet ports;

a pair of pumping gears within said pumping chamber;

means for rotatably supporting said pumping gears within said pumping chamber with a portion of teh peripheral tips of said pumping gears respectively in relatively close running clearance with said pressure faces; and means for slidably adjusting the position of said slider plate relative to said housing members to selectively reduce the running clearance between said pumping gears and said pressure faces;

said slider plate having a plurality of elongated connector bolt slots formed therein generally in parallel with each other and in parallel with a direction for moving said pressure faces to increase and decrease said running clearance, and a plurality of connector bolts extending respectively through said slots and fastened between said housing members;

said slider plate further including a pluraltiy of adjustment slots extending generally in parallel with said connector bolt slots, alignment pins anchored between said housing members and extending respectively through said adjustment slots, and adjustment screws respectively bearing against said alignment pins and threadably supported generally coaxially with said adjustment slots for drawing said slider plate pressure faces toward reduced running clearance with said pumping gears upon rotation of said adjustment screws.

4. The gear pump of claim 3 further including means for rotatably dirivng said pumping gears.

5. The gear pump of claim 3 wherein said pumping gears are supported in meshed relation within the pumping chamber.

* * * * *